United States Patent [19]

Fosgate

[11] Patent Number: 4,932,059

[45] Date of Patent: Jun. 5, 1990

[54] VARIABLE MATRIX DECODER FOR PERIPHONIC REPRODUCTION OF SOUND

[75] Inventor: James W. Fosgate, Heber, Utah

[73] Assignee: Fosgate Inc., Heber City, Utah

[21] Appl. No.: 142,140

[22] Filed: Jan. 11, 1988

[51] Int. Cl.[5] ..... H04S 3/00

[52] U.S. Cl. ..... 381/22

[58] Field of Search ..... 381/18, 19, 20, 21, 381/22, 23

[56] References Cited

U.S. PATENT DOCUMENTS 4,525,855 6/1985 Willcocks ..... 381/22

4,704,728 11/1987 Scheiber ..... 381/22

*Primary Examiner*—Forester W. Isen

*Attorney, Agent, or Firm*—Freilich, Hornbaker, Rosen & Fernandez

[57] ABSTRACT

An interface circuit for inclusion in the control signal path of a variable matrix decoder wherein the attack and decay time constants imposed on said control signals may be varied by means of an auxiliary circuit which responds to the total signal level applied to the decoder and to sudden changes thereof, thereby improving the dynamic performance of the variable matrix decoder.

9 Claims, 7 Drawing Sheets

VARIABLE MATRIX DECODER FOR PERIPHONIC REPRODUCTION OF SOUND

BACKGROUND OF THE INVENTION

This invention relates to improvements in matrix decoding apparatus intended for the periphonic reproduction of sound, using encoded information signals. Many types of decoding apparatus for this purpose exist in the prior art, particularly in relation to four-channel decoding of surround sound encoded by phase and amplitude matrixing onto two channels for transmission or recording using stereophonic media.

In the multichannel decoding apparatus according to the prior art, there are both fixed matrix decoders and variable matrix decoders. Fixed matrix decoders are those in which a plurality of input signals containing encoded information relating to the directions of sound sources are summed in appropriate proportions and phases to yield a plurality of output signals suitable, after amplification, for driving a corresponding plurality of surrounding loudspeakers in a room, the process being describable in terms of a matrix transformation in which the matrix coefficients are fixed and time-invariant. The optimum performance of such decoders occurs when the decoding matrix is the pseudo-inverse of the encoding matrix, as shown by J. V. White in his paper "Synthesis of 4-2-4 Matrix Recording Systems," J. Audio Eng. Soc., Vol. 24, No. 5 , pp. 250–257, May 1976. Such a decoder is said to be matched and no further improvement in its performance is possible unless the coefficients can be varied dynamically.

Variable matrix decoders also matrix a plurality of encoded input signals to produce a plurality of output signals suitable for driving a multichannel loudspeaker system, but the decoding matrix coefficients do not remain fixed. Instead, they are varied by means of a directionality sensing and control system, which continually monitors the correlations in phase and amplitude ratios between the input signals and adjusts the decoding coefficients to provide the maximum possible enhancement of directional cues for the most prominent sound sources at any instant of time. Typical of such decoders are those of Scheiber, U.S. Pat. No. 3,632,886; Bauer, U.S. Pat. No. 3,708,631; ITo and Takahashi, U.S. Pat. No. 3,836,715; Kameoka, et al., U.S. Pat. No. 3,864,516; Tsurushima, U.S. Pat. No. 3,883,692; Gravereaux and Budelman, U.S. Pat. No. 3,943,287; Willcocks, U.S. Pat. No. 3,944,735; Olson, U.S. Pat. No. 4,018,992; and Gerzon, U.S. Pat. No. 4,081,606. While the detailed circuitry and methods used to implement the variation of decoding matrix coefficients in these and numerous other matrix decoders differ, all of the known decoder systems utilize means for determining from the encoded signals present at their input terminals the predominant components of the sound field, deriving therefrom a number of control signals, which are in turn used to vary gain parameters of the decoder and thereby modify the decoding coefficients to optimize the directional cues in the reproduction of those sounds.

Because the control signals and the corresponding decoder matrix coefficients in such systems vary in time, careful attention must be paid to psychoacoustic performance, including phenomena which are known to those skilled in the art such as breathing or pumping effects, mislocalization or apparent wandering of sound sources, modulation of noise associated with the signals, fluctuation of the total sound level, harmonic and intermodulation distortion caused by too rapid variations in the control signals and other effects.

Undesirable effects can also occur because of imperfections in the performance of decoders and also of the encoders and media used to transmit, store or reproduce the information.

This invention represents a new approach to the optimization of the dynamic characteristics of the control signals present in decoding apparatus of the types described in the known patents so as to maximize the desired directionality enhancement effects while minimizing the undesirable effects mentioned above. It may be incorporated into any such decoder system with beneficial results.

In a well-designed control signal generator in such a decoder, the control signals and their sum can be assumed to behave in a manner that will result in correct separation, localization and placement of individual predominant sound sources. However, under dynamic conditions, if the control signals are permitted to vary fast enough to follow all the variations of predominant directionality, the resulting presentation will accentuate intermodulation distortion effects and rapid localization changes and any localization instability due to noise or rumble. The intermodulation distortion is reduced if the time constants are made longer, but the effects of slow image localization shifting, breathing or noise modulation and pumping are more evident under these conditions.

Some of the prior-art decoder systems have attempted to address this problem. Willcocks, in U.S. Pat. No. 3,944,735, "Directional Enhancement System for Quadraphonic Decoders," describes an attack and decay time constant processor section wherein each control signal is stored on a capacitor which is discharged at a variable rate depending upon the relative strength of other control signals present. The attack time constants are always short, and are unaffected by the other control signals. While such a time-constant processing circuit does have some benefits, a side-effect is that the sum of the control coefficient signals can exceed the optimum level causing more severe level variations and deterioration of the sharpness of localization under some circumstances.

Kameoka, et al., in U.S. Pat. No. 3,864,516, "Four-Channel Stereophonic Sound Reproduction System," includes a circuit which normalizes the sum of the control coefficients to a predetermined value at all times, thereby minimizing this effect. However, without a time-constant processor, this circuit may actually accentuate some others of the undesirable effects listed above.

SUMMARY OF THE INVENTION

The method of the present invention differs from the above-mentioned references in that both attack and decay time constants are controlled in an optimum manner to decrease the attack time constants and increase the decay time constants. The criteria used to determine the optimum time constants at any moment are clearly related to known psychoacoustic effects.

It has been found that if the attack time constant of the control signals in such a decoder is too short, intermodulation effects will be heard even with long decay time constants. However, if the time constants are short only during a signal attack and become longer when the attack is complete, the resulting intermodulation is inaudible. It has also been observed that when a sound displays a sudden onset, or attack, the localization of the sound by the ear-brain combination is particularly precise, whereas steady or slowly varying sounds are harder to localize.

Therefore, the present invention contains means for determining the onsets of sounds at high levels and rapidly increasing the rate at which the decoder responds to such sounds. However, the control coefficients are permitted to vary rapidly only for a short enough period that no intermodulation distortion is audible.

Furthermore, at lower overall signal levels, where record media inperfections such as surface noise, tape hiss, scratches or warps, or turntable rumble might become significant and disturb the correct operation of the decoder in the reproduction of sound, the response rates are slowed down to cause averaging of the control signals, thereby reducing the possibility of such unwanted effects.

Thus, the present invention relates to improvements in surround-sound systems intended for multi-loudspeaker reproduction of sounds from all directions around a listener. More particularly, it provides improvements in performance and reduction of undesirable effects when used in conjunction with, and as an internal subsystem of, a variable matrix decoder otherwise constructed according to known principles of the prior art. Such prior-art variable matrix decoders invariably contain some means for generating from their input signals a number of control signals which are then used to vary the parameters of the matrixing of the input signals required to produce output signals having enhanced directionality.

The apparatus of this invention is a time constant processing means which acts on the control signals for imposing variable attack and decay time constants thereon, so as to permit very rapid and accurate response to sudden attacks or transient sounds while maintining smooth, distortinless performance when such attacks are absent. At low signal levels, the time constants are further increased to reduce the undesirable effects of noise and rumble.

The inclusion of this apparatus within a variable matrix decoder improves its performance by optimizing its control action taking into account known psychoacoustic factors and by minimizing the undesirable effects commonly present in such decoders made according to the prior art.

The novel features that are considered characteristic of this invention are set forth with particularity in the appended claims. The invention will best be understood from the following description when read in connection with the accompanying drawings.

DESCRIPTION OF PREFERRED EMBODIMENTS

General Description of the Invention

Figure 1A:
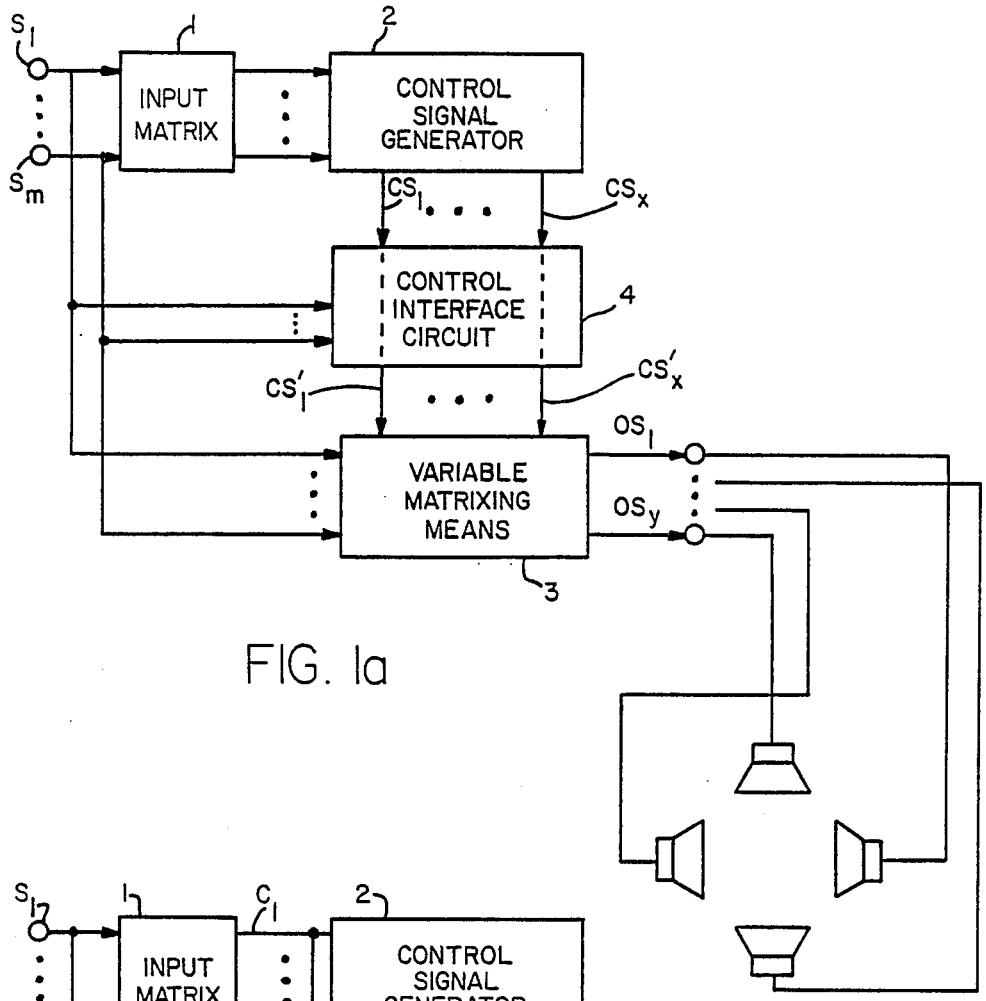
FIG. 1*a* is a functional block diagram of a variable matrix decoder according to the prior art wherein a control signal interface has been incorporated according to the invention.

FIG. 1*a* shows in a block diagram how a digital control interface subsystem according to the present invention is inserted in a variable matrix decoder according to the prior art to improve its performance. A plurality of encoded input signals $S_1 \ldots S_n$ are applied to input terminals, one input terminal for each encoded signal present. In accordance with the prior art, an input matrix 1 is used to provide a plurality of combinations $C_1 \ldots C_m$ of these signals to a control signal generator 2, which generates a plurality of control signals $CS_1 \ldots CS_x$ representing the directional content of the encoded input signals applied to a variable matrixing decoder. The control signal generator may sense and respond to absolute or relative amplitudes, amplitude ratios, or relative phases of the input applied to it, or combinations thereof. Thus, the input audio signals $S_1 \ldots S_n$ applied to the input matrix are also applied to a controllable variable matrix decoder 3 wherein they are matrixed to produce a plurality of output signals $OS_1 \ldots OS_y$ appearing at output terminals of the decoder.

Figure 1B:
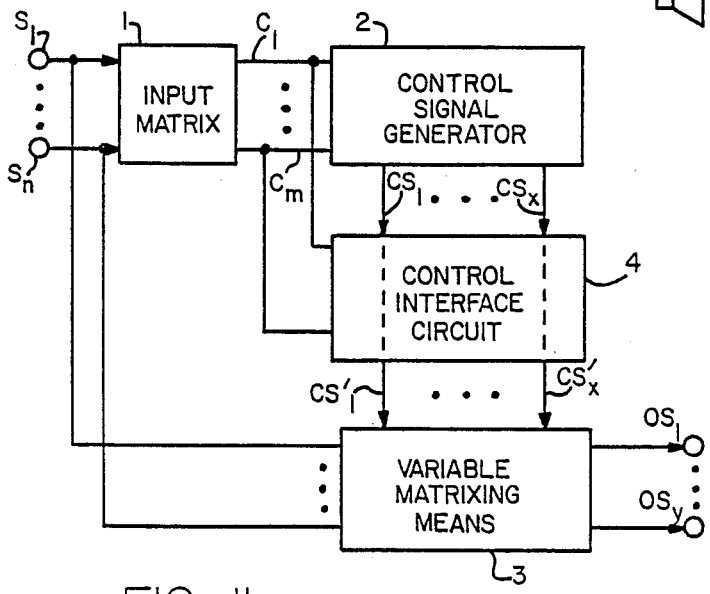
FIG. 1*b* illustrates a variation of the system of FIG. 1.

In this matrix decoder, the control signals $CS_1 \ldots CS_x$ from the control signal generator 2 would normally be directly applied to its control inputs, and would vary the matrixing coefficients in the manner prescribed for the particular decoder type, in accordance with the known techniques of the prior art, but in accordance with the present invention a control interface circuit 4 is inserted in the control signal path. In addition, as indicated by the dashed lines, the input signals $S_1 \ldots S_n$ (or some combination thereof $C_1 \ldots C_m$ from the input matrix 1 shown in FIG. 1*b*) are applied to this control interface circuit 4 in order to determine the total signal level of the input signals $S_1 \ldots S_n$, or alternatively if this function is already provided within the existing control signal generator 2, as is often the case, a signal representing the the total input signal level may be applied to the control interface circuit 4.

Figure 2:
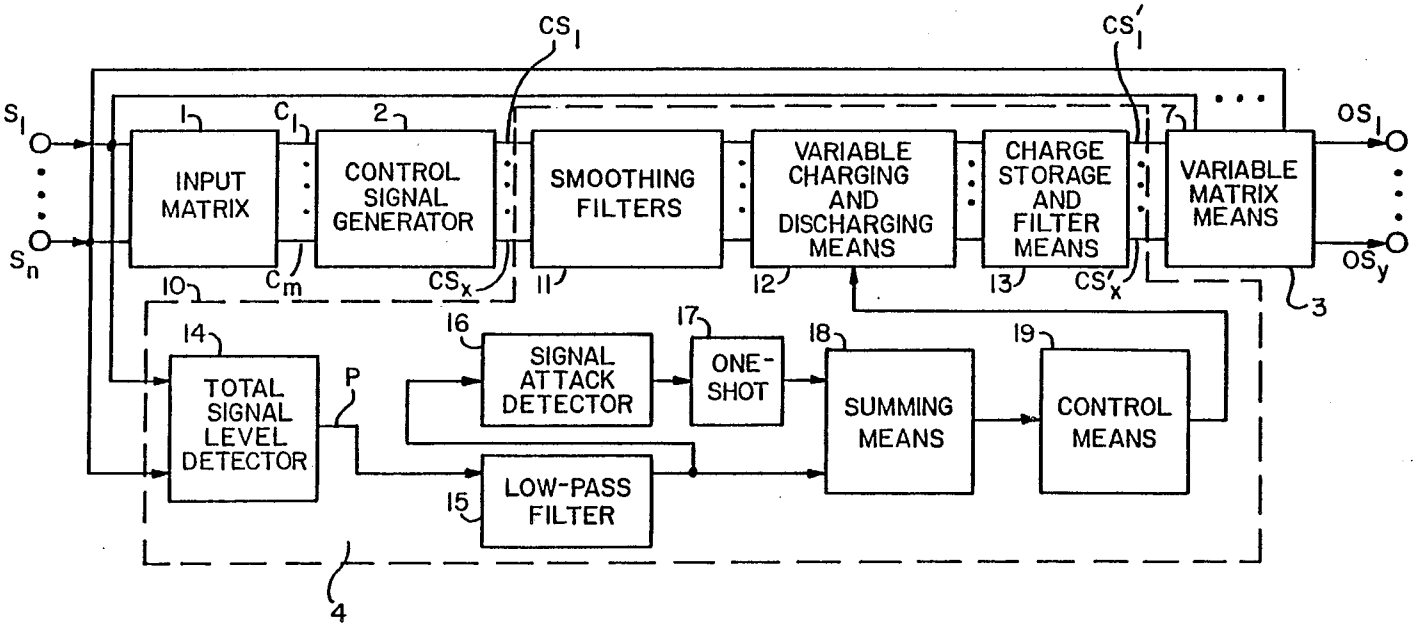
FIG. 2 is a functional block diagram of a control signal interface according to the invention, which is incorporated in a variable matrix decoder.

Referring now to FIG. 2, which represents the main components of the digital control signal interface circuit 4 in the context of a variable matrix decoder according to the prior art, the invention comprises the control interface circuit within a dashed line 10 implemented with functional blocks 11 through 19. As described with reference to FIG. 1, the input signals $S_1 \ldots S_n$ are applied to terminals of the input matrix 1 whose output signals $C_1 \ldots C_m$ are applied to the control signal generator 2. The input signals $S_1 \ldots S_n$ are also applied to a total signal level detector 14, which as mentioned previously may be an existing part of the control signal generator 2.

The total signal level detector 14 monitors all of the input signals $S_1 \ldots S_n$ present and computes as nearly as possible a signal P corresponding to the total acoustic signal power that should be present in the listening room, independent of the directional content of the signal information. Since the ear's amplitude response is essentially logarithmic, it is preferable that this level detector also respond logarithmically in producing the signal P.

In the upper circuit path of FIG. 2, the output signals $CS_1 \ldots CS_x$ from the control signal generator 2 are first applied to smoothing filters 11, which may also be an existing part of the control signal generator 2. From these filters, the control signals pass to a variable charging and discharging means 12, and thence to charge storage and filter means 13. The smoothed outputs $CS'_1 \ldots CS'_x$ from this functional block 13 are applied to the existing variable matrix decoder 3 wherein the audio output signals $OS_1 \ldots OS_y$ are produced.

In the lower circuit path of FIG. 2, the output p of the total signal level detector 14 is applied to a low-pass filter 15 and also to a signal attack detector 16. The output of this signal attack detector is applied to a one-shot (monostable multivibrator) 17. The outputs of the one-shot 17 and the low-pass filter 15 are applied to a summing means 18, which produces the sum of these signals. In that manner, the one-shot pulse produced upon detecting an attack in the total signal level detector 14 is superimposed on the total signal which is applied to controls means 19, whose output signal controls the variable charging and discharging means 12 in the upper circuit path.

The low-pass filter 15 operates on the output of total level detector 14 to provide a smoothed output signal which does not change rapidly in response to sudden attack characteristics in the input signals. The signal attack detector 16 responds to any such sudden changes of signal level that are of sufficient magnitude to be defined as signal attacks, and triggers the one-shot 17 when such attacks are detected to mark the onset of an attack on the low-pass filtered signal P. The summing means 18 combines the outputs of the one-shot multivibrator 17 and low-pass filter 15 in suitable proportions, which depend upn the relative importance of attacks and of slower level changes in determining the interface time constants.

The control means 19 responds to the output signal of the summing means 18 by generating a suitable control signal for operation of the variable charging and discharging means contained within the functional block 12. In the preferred embodiments of the invention described below, the control means 19 typically generates a pulse width modulated train whose duty cycle is a function of the applied voltage derived from the summing means 18. This pulse width modulated train operates series and parallel switching elements in the functional block 12 in order to regulate the transfer of charge to and from charge storage and filter means 13. Digital switching transients and ripple generated by this action are filtered out by the smoothing filter in the functional block 13 so that smoothed control signals are presented to the following variable matrixing means 3.

When the total signal level is low, and no significant attacks are occurring, the time constants imposed on the variable matrixing control signals are generally long, and the variations in the decoding function of the matrixing means 3 are slow and gentle. At higher signal levels, the response is somewhat faster, as typically the effects of intermodulation are less perceptible and those of image instability due to rumble and noise are less likely to occur. When a signal attack is recognized, the one-shot 17 is triggered to produce a higher control signal that, for a brief interval, effectively allows the control signals from the generator 2 to pass to the variable matrixing means directly, with only minimal smoothing time constants. When the one-shot 17 relaxes to its normal state, the time constants return to their longer values, and the circuit operation reverts to a slower varying condition.

The effect of this is particularly favorable to sustaining the correct localization of vocalists, as low level breathing sounds and sibilants remain correctly placed when the sound levels are decaying. Music in which large dynamic variations and rapid somic interchanges occur will nevertheless be accurately reproduced as each attack resets the control coefficients to the correct levels for optimum localization quickly enough to fool the ear-brain responses, yet smooth and distortion-free performance occurs between these moments.

Preferred Embodiments of the Invention

Figure 3:
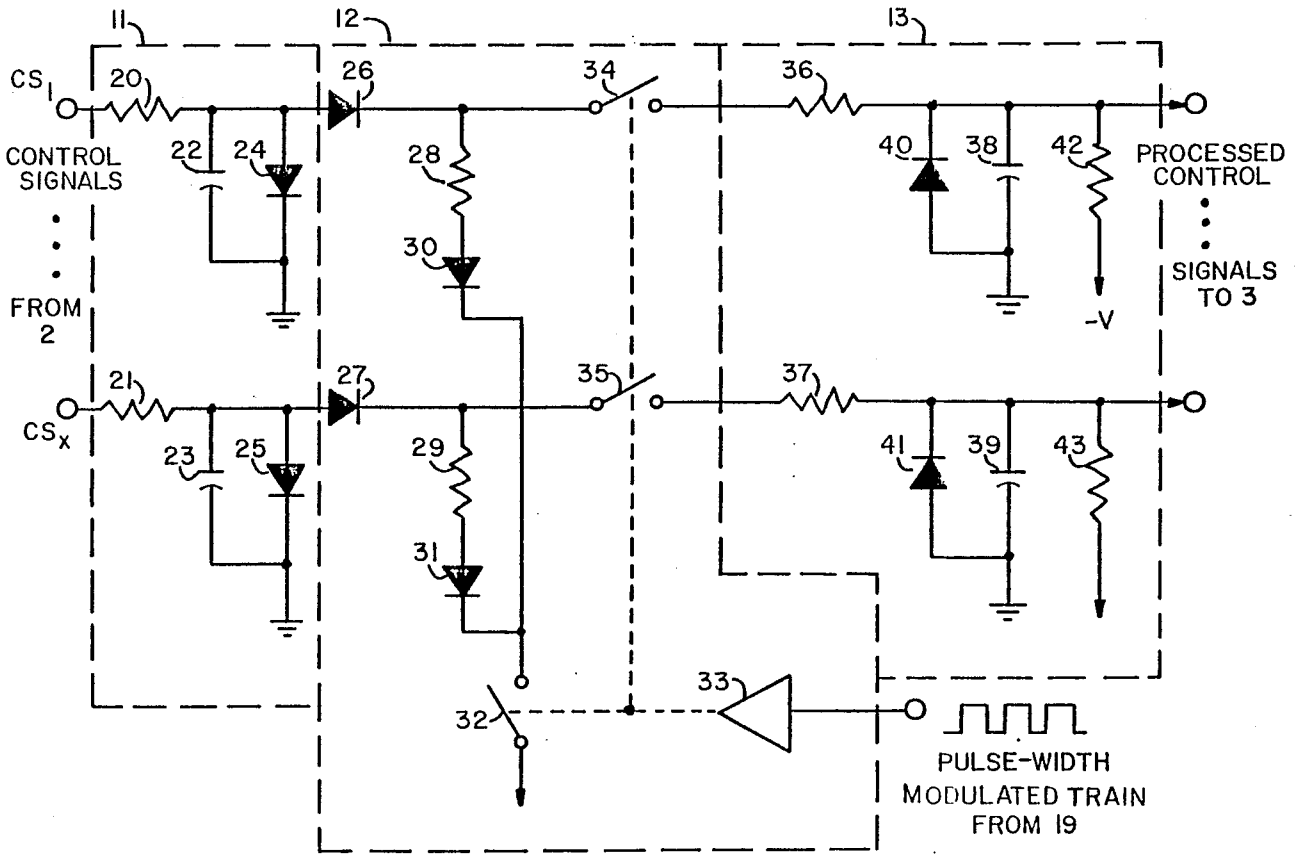
FIG. 3 is a circuit diagram of a preferred embodiment of means for a variable time constant control forming part of the control interface circuit shown in FIGS. 1 and 2.

FIG. 3 shows a schematic diagram of a preferred embodiment of the upper part of the control interface circuit 4 of FIG. 2, comprising the smoothing filters 11, the variable charging and discharging means 12, and the charge storage and output filtering means 13. These three functional block sections are separated by correspondingly numbered dashed lines in FIG. 3.

Only the two control signals paths are shown in FIG. 3, but as many identical control signals paths as necessary would typically be provided, as indicated by the ellipsis for the input and output signals $CS_1 \ldots CS_x$ and $CS'_1 \ldots CS'_x$ at input and output terminals of FIG. 3. The input filter, which may already be present in the control signal generator 2 of FIG. 2, comprises resistors 20 and 21 in conjunction with capacitors 22 and 23, respectively. Diodes 24 and 25 are included to limit the positive excursion of the control signals shown to a predetermined maximum level.

The time constant for smoothing the control signals may be typically quite short, for example, using resistors of 1.0kΩ and capacitors of 2.2 μF, the time constant is 2.2 ms. A somewhat longer time constant of 10 to 25 ms would be necessary to avoid excessive intermodulation distortion if the present invention were omitted.

The variable charging and discharging means of functional block 12 comprise diodes 26 and 27, resistors 28 and 29, diodes 30 and 31, switches 32, 34 and 35 and switch buffer 33. All switches would, in practice, be implemented with suitable electronic switches. Diode 26 permits positive-going excursions of the control signal $CS_1$ to pass through to the output side of the circuit, but becomes nonconducting if the input control voltage falls. Resistor 28 and diode 30 form a discharge path for the control signal $CS_1$, and resistor 29 and diode 31 form a similar discharge path for the control signal $CS_y$. Voltage-controlled switch 32 operates periodically at the system clock rate, which should preferably be above the audible frequency range. Switches 34 and 35 also operate at the same rate and with the same duty cycle. The effect of a duty cycle of 1/n is to multiply the resistances in the circuit by a factor of n, increasing the time constants by the same factor n. Thus, the effective value of resistors 28 and 29 is n times the physical value, which may be typically 2.2 kΩ. The switches are controlled by the buffer amplifier 33, which receives the train of switching pulses at the system clock rate with the switching pulses width modulated at the input of the buffer amplifier 33.

The charge storage and filtering means of the functional block 13 comprises resistors 36 and 37, capacitors 38 and 39, diodes 40 and 41 and resistors 42 and 43. Capacitors 38 and 39 store the charge transmitted through switches 34 and 35 from the outputs of the control signal generator 2. They may typically have values of 0.47 μF. Resistors 36 and 37 may be typically 1.0 kΩ and are also multiplied by the factor n due to the switching action described previously. Diodes 40 and 41 limit the negative excursion of the control signal voltages, and resistors 42 and 43, which may be 10MΩ, provides a slow discharge time constant of typically 4.7 s for the control signal voltages.

When the switch 34 and switch 32 are on, the discharge path resistance is 2.2 kΩ, and both capacitors 22 and 38 may be discharged through this path, the effective time constant being about 5 ms. If the signal voltage driving resistor 20 is rising, the effective charging time constant due to the two capacitors and resistors in the circuit will be about 2.7 ms. Hence, the response to variations in the input control voltage is very rapid, and the output control voltages of the interface will typically have settled to a condition reflecting all of the input control voltages within about 5 to 10 ms. Thus, the time period for which the one-shot 17 remains on after it has been triggered by the signal attack detector 16 should be on the order of 10 ms.

When the switches 32 and 34 are on only for a small duty cycle 1/n, where $n>>1$, the circuit behaves as if only the second time constant, due to resistor 36 and capacitor 38, were effective for charging, and that due to resistor 28 in series with resistor 36 and capacitor 38 for discharging. Thus, the discharging time constant will be approximately three times the charging time constant, but both may be quite slow. For example, if $n=100$, the effective values of resistors 28 and 36 may be 220 kΩ and 100 kΩ, respectively, and the time constants may be 47 ms for charging and 150 ms for discharging.

The principal advantage of using the pulse-width modulation control technique described in that the performance of the variable time constant elements in each of the control signal paths through the interface circuit 14 is closely controlled and matched. This avoids any possible biasing of the decoder's dynamic characteristics towards or away from any particular condition, whereas if analog variable resistance elements were used it may be very difficult to obtain such precise matching over a wide range of operation.

Figure 4:
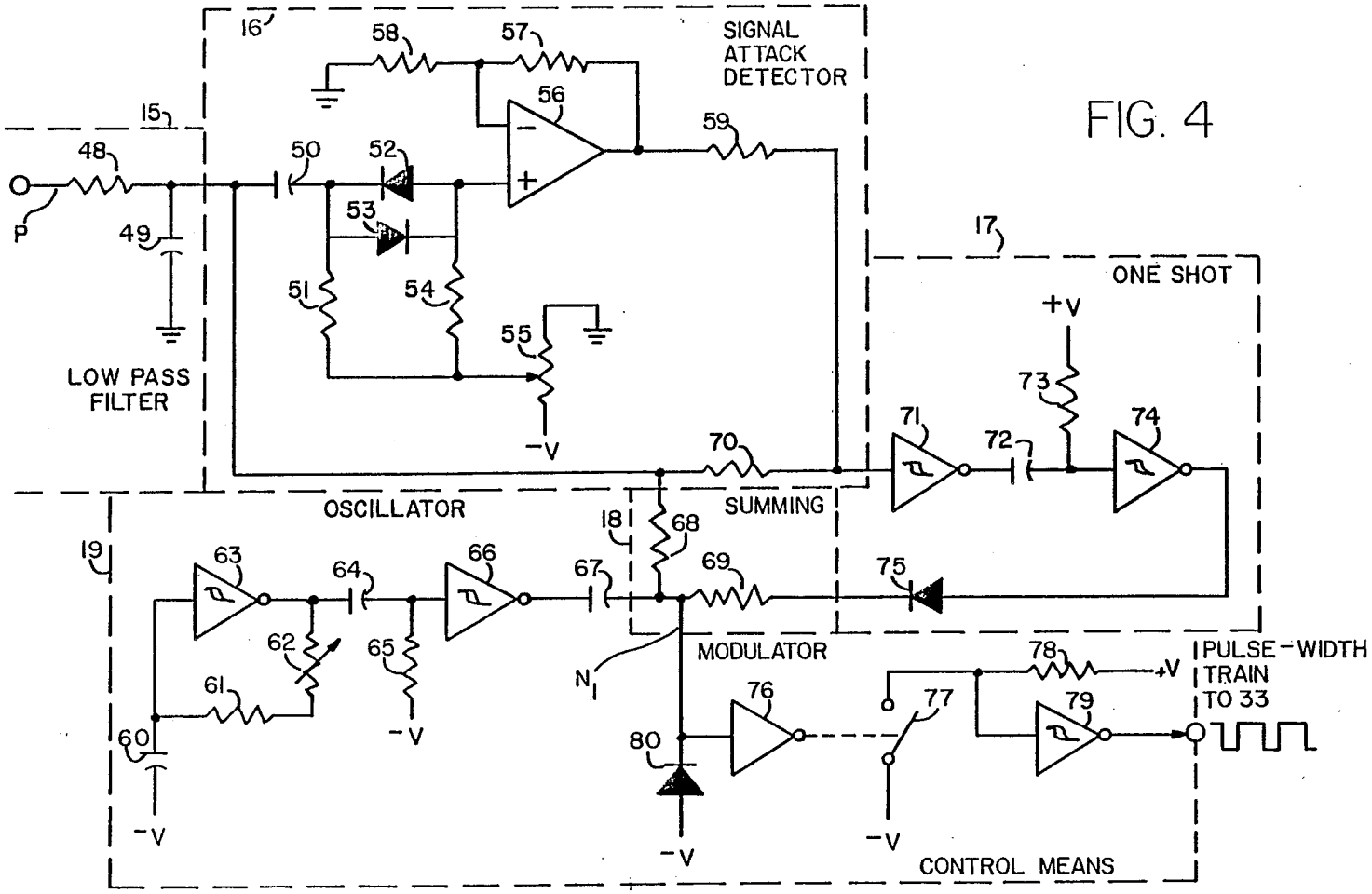
FIG. 4 is a circuit diagram of a preferred embodiment of means for generating a digital control signal for controlling the variable time constant means shown in FIG. 3.

Referring now to FIG. 4, which is a circuit diagram of the means for generating the pulse width modulated train required to drive the switch buffer 33 in FIG. 3, a voltage P representing the output of the total signal level detector 14 of FIG. 2 is applied to a low-pass (smoothing) filter 15 comprising resistor 48 and capacitor 49. These components may have typical values of 10 kΩ and 0.47 μF, respectively, defining a smoothing time constant of about 5 ms.

The output of this smoothing filter is applied to a summing junction (node $N_1$) at the input of modulator switch buffer 76 via resistor 68. Capacitor 67, which is present for the purpose of transmitting pulses to the modulator switch buffer 76 provides very little smoothing as the value of capacitor 67 may be typically 220 pF and resistor 68 may be 100 kΩ, representing a time constant of 22 μs. The required low-pass filtering is effectively done by resistor 48 and capacitor 49.

This output voltage of the smoothing filter 15 is also applied to the signal attack detector 16, which consists of circuit elements 50 through 59 of FIG. 4. Input capacitor 50 couples the signal to resistor 51 and to diodes 52 and 53 both of which are normally nonconductive. The direct voltage at the junction of these components is defined by the setting of potentiometer 55. This voltage is also applied to a noninverting input terminal of operational amplifier 56 through resistor 54. The gain of operational amplifier 56 is defined by resistor 58 connected between its inverting input and ground, and feedback resistor 57. In the typical case, these resistors may have values of 10 kΩ and 100 kΩ, respectively, for a voltage gain of 11. Potentiometer 56 is connected between ground and the negative supply voltage, and may be adjusted so that the quiescent voltage appearing at the output of amplifier 56 is close to the negative supply voltage.

Typical values of resistor 51 and capacitor 50 may be 100 kΩ and 2.2 μF, respectively, for a time constant of 220 ms. Diodes 52 and 53 are typically silicon signal diodes having a forward voltage of about 0.6 V at the onset of significant conduction currents.

When a signal attack of sufficient magnitude occurs in a short enough time, diode 53 conducts, and the positive-going voltage is transmitted through diode 53 to the noninverting input of amplifier 56. It is amplified by the defined gain of amplifier 56 and causes the output voltage of the amplifier to change in a positive-going direction. This voltage is applied via resistor 59 to the input of the one-shot 17. Also, resistor 70 applies a proportion of the voltage appearing at capacitor 49 directly to the same point.

Typical values of resistors 59 and 70 may be 100 kΩ and 130 kΩ, respectively, yielding a gain of 0.43 to the input of the one-shot 17 for the direct signal, which increases to about 6.7 when an attack large enough to cause diode 53 to conduct occurs.

The one-shot 17 of FIG. 2 may be implemented in many different ways known to those skilled in the art, such as for example, in accordance with the way shown in FIG. 4 comprising circuit elements 71 and 74. In this circuit, element 71 is an inverting Schmitt trigger buffer which may be one of six provided on a Motorola CMOS type MC14584 integrated circuit available commercially. When the voltage at the input of Schmitt trigger element 71 exceeds a fixed positive threshold voltage, its output switches rapidly from a potential close to the positive supply voltage to a potential near the negative supply voltage.

This transition is applied through capacitor 72 to registor 73 and the input of a second inverting Schmitt triggers buffer element 74. The input of this element is normally at the positive supply potential, which is applied to it via resistor 73. Its output voltage is therefore normally at the negative supply potential, until the pulse transition from capacitor 72 drives the input of the Schmitt trigger element 74 negative and its output then switches to the positive supply voltage. Provided that the output of the Schmitt trigger element 71 remains negative for a sufficiently long time, the voltage on the input of the Schmitt trigger element 74 rises exponentially with a time constant determined by resistor 73 and capacitor 72 until the positive threshold voltage is reached, whereupon the output of the Schmitt trigger element 74 switches to the negative supply potential, and remains there until another attack is sensed. This will occur in about 0.75 times the time constant. With typical values of 10 nF and 1.0 MΩ for these components, the time constant is 10 ms, and the duration of the output pulse will be about 7.5 ms.

If the voltage applied to the Schmitt trigger element 71 falls below its negative threshold voltage during the ouput pulse generated by the Schmitt trigger element 74, the Schmitt trigger element 71 will switch back to its quiescent state producing a positive-going transition at its output and forcing a negative-going transition at the output of the Schmitt trigger element 74, thus terminating the pulse immediately.

The pulse appearing at the output of the Schmitt trigger element 74 is applied through diode 75 and resistor 69 to the summing node $N_1$ at the input of the buffer 76. Thus, the do voltage on capacitor 49 is applied to node $N_1$ through resistor 68 and a train of pulses is applied through capacitor 67. These pulses are derived from an oscillator comprising elements 60 through 66, which may be included in the functional block 19 of FIG. 2.

Inverting Schmitt trigger element 63 in conjunction with capacitor 60, resistor 61 and variable resistor 62 forms a free-running astable multivibrator. Its output switches between the positive and negative supply voltages at a frequency determined by the total resistance of resistors 61 and 62, the capacitance of capacitor 60 and the hysteresis voltage, or the difference between the positive and negative threshold voltages, of the Schmitt trigger element 63. With typical values of 1.0 MΩ for resistor 61 and 62 and 220 pF for capacitor 60, a time constant of 220 to 440 μs may be realized, and with the typical hysteresis of 1.1 V and total supply voltage of 15 V, the resulting oscillation frequency may be 7.5 to 15 kHz.

The value of resistor 61 would normally be chosen to give the desired oscillator frequency when the hysteresis is at its maximum of 1.5 V (in this case about 11.4 kHz), and the variable resistor 62 would be chosen to accommodate the adjustment for the lowest hysteresis of 0.6 V to yield the same frequency. To cover a range of temperature variation as well, variable resistor 62 might be about twice the value of fixed resistor 61.

Capacitor 64 couples the output pulses from oscillator 63 into another inverting Schmitt trigger element 66, which acts similarly to a one-shot element as described above. In this case, the output voltage is quiescently at the positive supply potential, and swings negative when pulses are applied to its input through capacitor 64. The pulse width is fixed at about 0.75 times the product of the values of capacitor 64 and resistor 65. With typical values of 22 pF and 13 kΩ, the pulse width is about 200 ns.

The negative-going pulses from the inverting Schmitt trigger element 66 are coupled through capacitor 67 to the input of the switch buffer 76, which acts as a pulse-width modulator. The quiescent voltage at this point is fixed by the voltage on capacitor 49 which is applied through resistor 68. When the negative-going pulses are applied to the buffer input, a substrate diode 80 forming part of the input protection circuit of the buffer element 76 conducts and capacitor 67 is discharged. After the pulse, the voltage at the input of buffer 76 is close to the positive supply voltage, and falls exponentially toward the quiescent voltage on capacitor 49. During this period, switch 77 is turned on, connecting the input of the inverting Schmitt trigger element 79 to the negative supply voltage, and forcing its output to the positive supply potential. This in turn results in all of switches 32, 34, and 35 of FIG. 3 being switched on in synchronism with switch 77.

When the voltage at the input of switch buffer 76 falls below its negative threshold voltage, switch 77 turns off (opens) and the positive supply voltage is applied through resistor 78 to the Schmitt trigger element 79. Its output switches to the negative supply voltage, switching off (opening) all of switches 32, 34 and 35 of FIG. 3. The duration of the pulse therefore depends on the value of the threshold voltage of the switch buffer and the standing voltage on the capacitor 49. With a judicious choice of nominal voltage and component values, the duty cycle may be made very short, if desired.

When the one-shot 17 is triggered, the output voltage of inverter 74 switches to the positive supply voltage, and is applied to the input of switch buffer 76 through resistor 69. With typical values of 100 kΩ each for resistors 68 and 69, the effective quiescent voltage is midway between the voltage on capacitor 49 and the positive supply voltage, and may be sufficient to prevent the voltage on the input of switch buffer 76 from falling to its negative trigger threshold. In this case, switch 77 is turned off only for the duration of the short negative pulses from one-shot 66, and the same applies to the switch elements of FIG. 3. Thus, when an attack is sensed, the interface circuit operates at the maximum speed possible for the duration of the pulse from the one-shot 74.

The total signal level detector 14 shown in FIG. 2 may already be included as part of the existing control signal generator 2 of the variable matrix decoder 3 shown in FIG. 1, in which case the present invention may be easily added to improve its performance. If not already present, a suitable circuit may be constructed according to the circuit diagram of FIG. 5, which corresponds in function with the total signal level detector 14 of FIG. 2.

Figure 5:
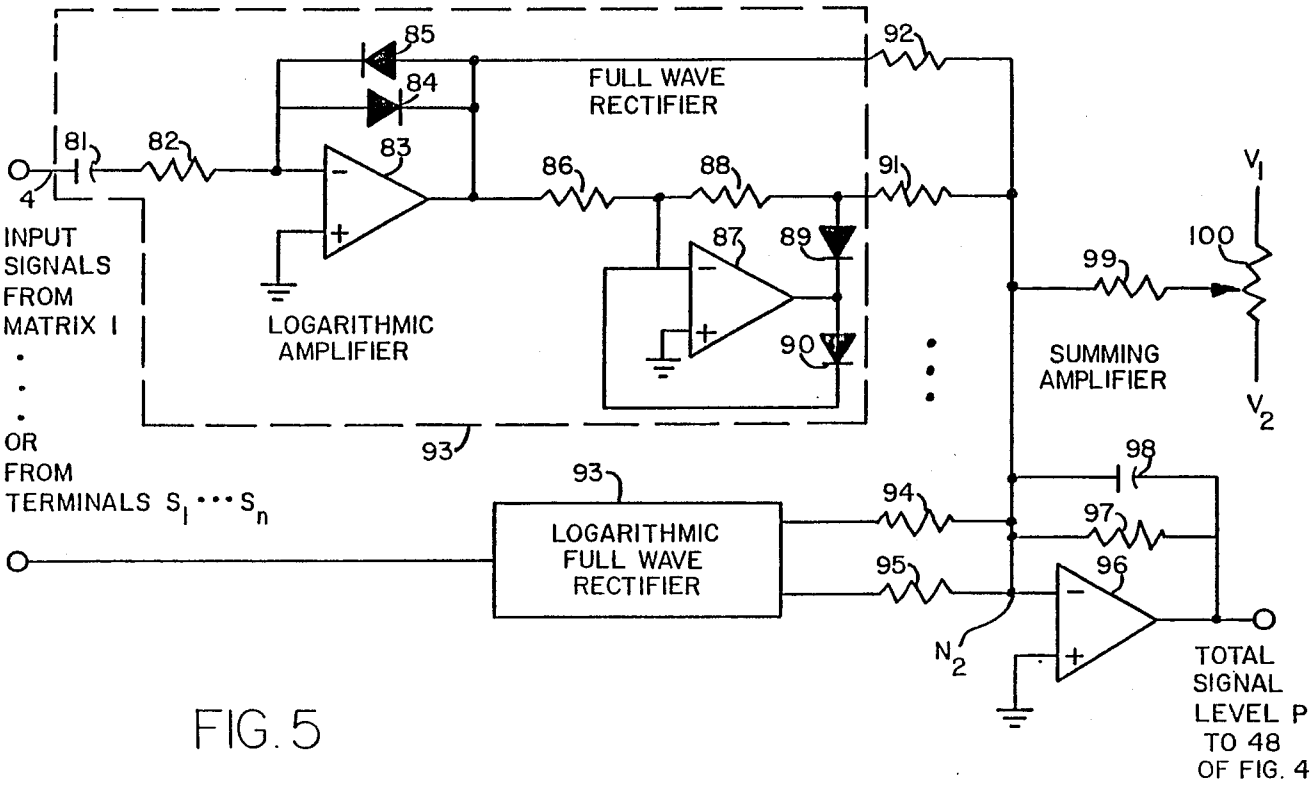
FIG. 5 illustrates a circuit diagram of a preferred embodiment of means for sensing total signal level which may be used in conjunction with the circuit of FIG. 4.

In the circuit of FIG. 5, operational amplifier 83 is configured as a logarithmic amplifier, employing reverse parallel diodes 84 and 85 as feedback elements. A signal is accoupled into the amplifier through capacitor 81 and resistor 82 in series. Diodes 84 and 85 are ideally matched and have a forward voltage proportional to the logarithm of the current over several decades of current. Matched diode arrays similar to RCA type CA3039, or diode-connected transistors such as are found in transistor array type LM3086 may be used for these diodes.

The output of amplifier 83 is coupled to operational amplifier 87, which performs a half-wave rectification function. When the input to this amplifier is positive, diode 89 and resistor 88 form the feedback impedance, and the voltage at the junction of these components is an exact inversion of the input voltage. When the input is negative, diode 89 is nonconductive, diode 90 conducts and the voltage at the junction of resistor 88 and diode 89 remains at ground potential.

This voltage is coupled into summing amplifier 96 through resistor 91, and the output of amplifier 83 is also coupled to the input of amplifier 96 through resistor 92, whose resistance is twice that of resistor 91. The current supplied to the virtual ground input of amplifier 96 is thus a full-wave rectified signal proportional to the logarithm of the input signal voltage applied to capacitor 81.

Similar circuitry in function block 93 delivers a full-wave rectified current proportional to the logarithm of the voltage applied to its input via resistors 94 and 95 to the summing node $N_2$. As shown by the ellipsis, additional circuits may also be connected to the summing input of amplifier 96. The gain of amplifier 96 is determined by feedback resistor 97, and an offset may be added by means of resistor 99 and potentiometer 100. Capacitor 98 serves to filter the sum of rectified waveforms to obtain a smooth output from amplifier 96.

The input signals to the logarithmic full-wave rectifiers of FIG. 5 may be derived from the input matrix circuit that forms part of the existing variable matrix decoder, or may be, for example, a pair of stereophonic signals and their sum and difference. The gain of amplifier 96 will also determine how large a change in level must occur before the one-shot 17 of FIG. 2 is triggered with an attack occurs. Typically, resistors 91 and 92 may have values of 100 kΩ and 200 kΩ, respectively, and resistor 97 may be 1.0MΩ, yielding a gain of 5 to each rectified signal component. If four such components are applied, and the input signal level changes over a ten to one range, or 20 dB, each logging diode will typically generate about 60 mV change in its forward voltage drop, yielding a total change of about 1.2 V at the output of amplifier 96. The effective sensitivity will thus be about 60 mV per dB at the output of amplifier 96. If the diodes 52 and 53 of FIG. 4 are of the silicon type, a change of over 10 dB will be required before an attack condition will be sensed.

Since the time constant in the input of the attack sensing circuit is quite long, on the order of 220 ms, attacks which occur in 100 ms or less will be detected fully, while slow changes of level, even over much larger ranges, will not trigger the attack sensing circuit since the diodes will not conduct. With the values suggested here, a rate of change of level of at least 45 dB per second will cause the attack sensing circuit to respond. For decaying signals this corresponds to an effective RT60 of 1.33 seconds or less.

Figure 6A:
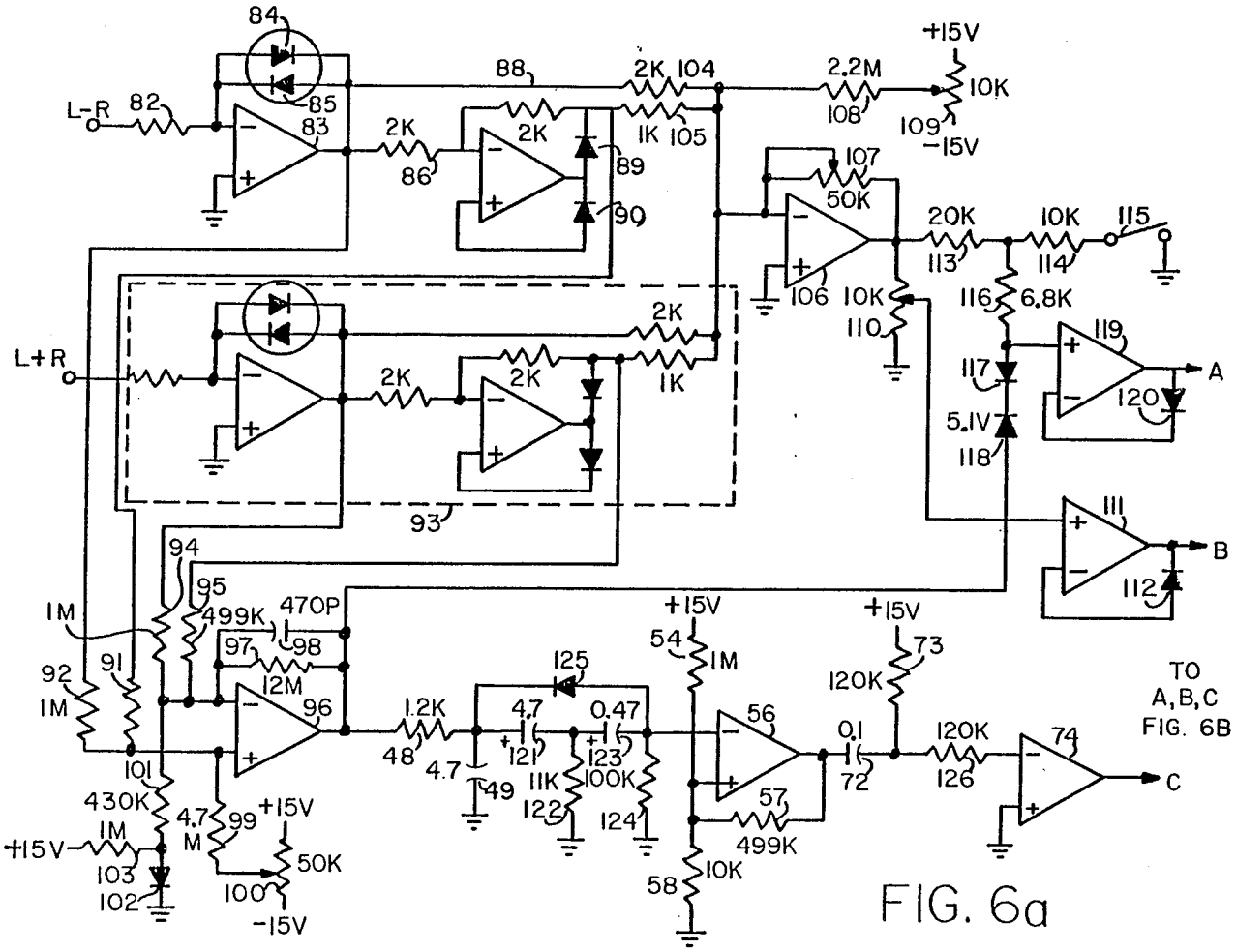
FIGS. 6*a* and 6*b* together illustrate a circuit diagram of a second preferred embodiment of the invention.
Figure 6B:
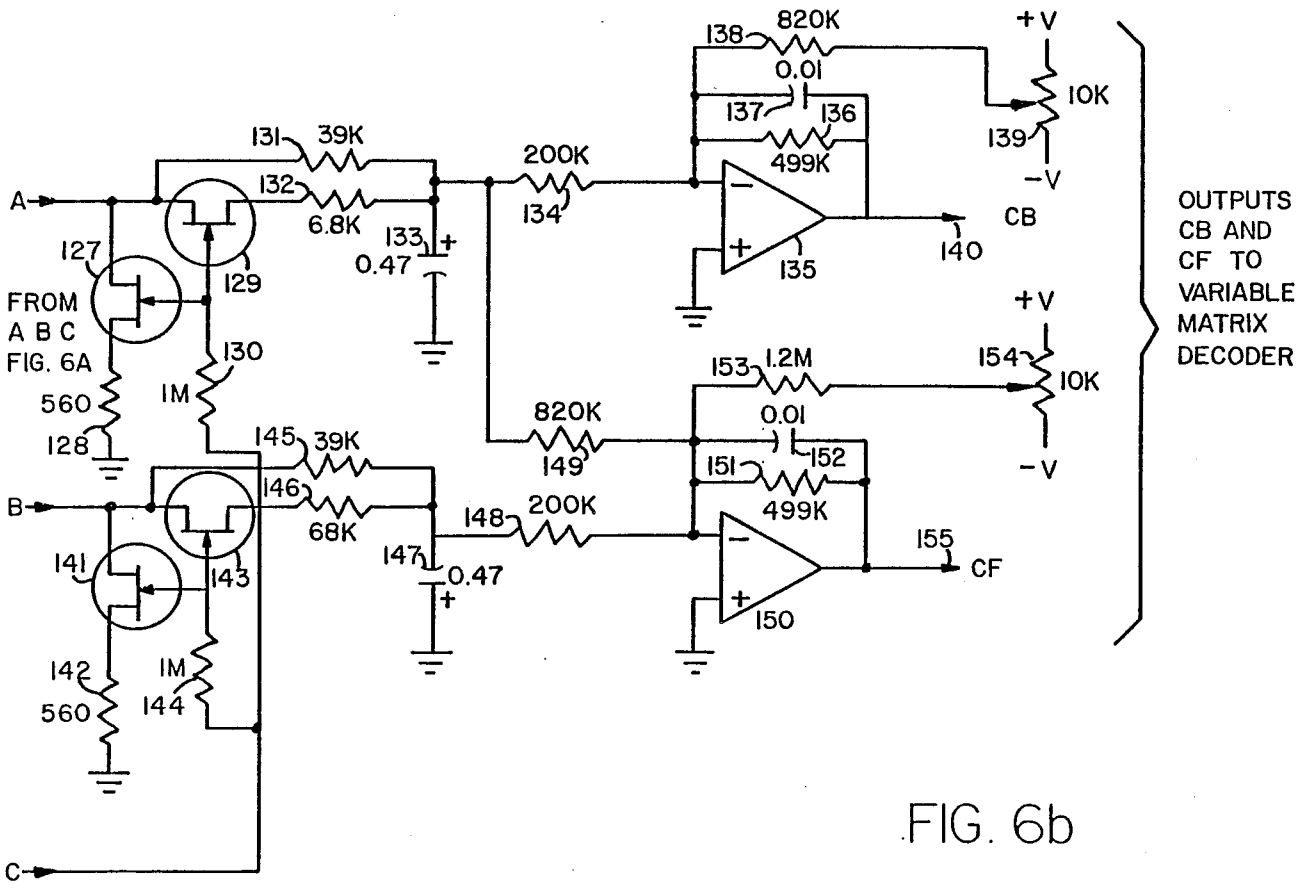

A second preferred embodiment is shown in FIGS. 6*a* and 6*b*. To facilitate understanding this embodiment, the same reference numerals of FIG. 5 are used for the same corresponding components. The signal rectifiers 84 and 85 shown in FIG. 5 are at the upper left of FIG. 6, and corresponding components are numbered similarly. The upper input terminal labelled L−R accepts an input voltage which is the difference of left and right channel signals. Components labeled 82 through 90 perform the same functions as in the previous description, except for the polarity of diodes 89 and 90, which are reversed. The second logarithmic full-wave rectifier inside the dashed line numbered 93 performs a similar function for the sum of left and right signals applied to the input terminal labeled L+R. Diodes corresponding to 89 and 90 are in the same polarity as in FIG. 5.

Because the polarity of the output from the L−R channel rectifier is reversed, summing amplifier 96 (in the lower left corner of the drawing) becomes a differencing amplifier, and components 91 through 100 perform the same functions as correspondingly numbered components in FIG. 5, apart from this difference. Resistor 101 provides a temperature compensating bias derived from the forward voltage of diode 102, which receives a bias current via resistor 103.

Amplifier 106 is driven from the logarithmic full-wave rectifier through the resistors 104, 105 and corresponding components in circuit block 93. This amplifier effectively forms the difference between the outputs of the logarithmic full-wave rectifiers. Potentiometer 107 controls the gain of amplifer 106, and resistor 108 and potentiometer 109 set up a bias to insure that the output of amplifier 106 is zeroed with no input signals present.

Potentiometer 110 picks off a proportion of the output of amplifier 106 as the raw center front control voltage. This is half-wave rectified and buffered by amplifier 111 with diode 112 connected in its feedback path. The output of this amplifier follows negative-going input voltages.

Resistors 113 and 114 connect a proportion of the outputs of amplifier 106 via resistor 116 to the input of a similar half-wave rectifier and buffer amplifier formed by amplifier 119 and diode 120. This amplifier passes positive-going output voltages. Switch 115 permits the proportion of the output of amplifier 106 to be changed in different operating modes of the decoder.

The output of summing amplifier 906 is applied through a filter circuit corresponding to that in FIG. 4. Resistor 48 and capacitor 49 form a low-pass filter with a time constant of about 5 ms. Capacitors 121 and 123 with resistors 122 and 124 form a two-stage differentiator, and diode 125 prevents the output of this differentiator from remaining higher than the voltage on capacitor 49. Amplifier 56 is connected as a Schmitt trigger circuit, with a bias voltage set by resistors 54 and 58, and hysteresis provided by positive feedback via resistor 57. When the voltage on the negative input of amplifier 56 goes positive, which occurs on fast positive-going signal attacks from the output of amplifier 96, the output of amplifier 56 which is normally biased to the positive supply rail rapidly switches to the negative rail for a short period.

This output pulse is differentiated by capacitor 72 and resistor 73, and applied via resistor 126 to the input of amplifier 74, which acts as an inverting buffer. The output of this amplifier therefore delivers a positive pulse of duration dependent on the time constant of resistor 73 and capacitor 72. The pulse duration is typically 8 ms.

Continuing with FIG. 6*b*, the pulse from amplifier 74 is applied to the gates of four field-effect transistors 127, 129, 141 and 143 via resistors 130 and 144. When the output of amplifier 74 is negative in the quiescent condition, the voltages appearing at the outputs of buffers 119 and 111 of FIG. 6*a* are applied through resistors 131 and 145 respectively to capacitors 133 and 147. These resistors and capacitors have time constants of typically 20 ms, but because of the diodes in the feedback around buffers 111 and 119, the decay times are effectively very long. They are determined by the loading of resistors 134 and 148, which give time constants of about 100 ms with capacitors 133 and 147.

Amplifiers 135 and 150 receive their inputs respectively via these resistors. Their gain is defined by feedback resistors 136 and 151, and further smoothing is provided by capacitors 137 and 152, with time constants of about 5 ms. Resistors 138 and 153 and potentiometers 139 and 154 set up the bias on these amplifiers for zero output at zero input signals. The outputs of these amplifiers, appearing at terminals 140 and 155, respectively, form the center back and center front control signals which drive the variable matrix portion of the decoder circuitry (not shown).

When the output pulse from amplifier 74 of FIG. 6*a* occurs, the gates of the field-effect transistors are driven positive, turning them on. This results in a fast discharge path via resistors 128 and 142 for the outputs of buffers 119 and 111, respectively, which insures that the signals at A and B follow the inputs of these amplifiers as long as diodes 120 or 112 conduct, and are at ground potential otherwise. The series paths from these terminals A and B are also connected via resistors 132 and 146, to capacitors 133 and 147, reducing the effective time constants to 2.7 ms.

Resistor 149 connects a proportion of the center back control signal into the center front channel, which tends to favor weaker center back attacks when center front signals are simultaneously present. The value of this resistor is a compromise and is selected for the best psychoacoustic effect.

While the circuit values here given can be taken as a guide to the optimum operating conditions in the interface circuit, considerable divergence from these values and performance ranges may be chosen without departing from the spirit of the invention.

What is claimed is:

1. In a variable matrix decoding apparatus intended for the periphonic reproduction of sounds using encoded input signals representing said sounds, a method of controlling both attack and decay time constants of said encoded input signals in order to reduce intermodulation effects to a level that is inaudible, comprising the steps of determining the onset of attacks of sounds at high input signal levels and rapidly increasing the rate, and therefore shorten the attack and decay time constants, with which the decoding apparatus responds to said signals for a predetermined short period, thereby minimizing the audibility of intermodulation distortion, and at lower overall input signal levels following each attack, reducing the rate, and therefore increasing the decay time constants, with which the decoder responds to said sounds, thereby reducing the possibility of producing imperfections in the periphonic reproduction of sound following attacks.

2. A method as defined in claim 1 wherein the step of determining the onset of attacks and increasing the rate at which said variable matrix decoding apparatus responds to an attack on said encoded input signals is carried out by logarithmic full wave rectification of said encoded input signals directly or combination signals derived from said encoded input signals by matrixing, summing and filtering said logarithmic full wave rectified signals to produce a smooth logarithmic signal, detecting a rapid increase in said smooth logarithmic signal to a predetermined level indicative of an attack, and in response to each detection of such an attack, increasing the duty cycle of a pulse-width modulated train for a defined controlled period short enough to minimize the audibility of intermodulation distortion, wherein each pulse produced at a constant rate is modulated to have a width proportional to the amplitude of said smooth logarithmic signal and the pulse width modulation is used to control the rate, and therefore the shortened attack time constants which said decoding apparatus responds to attacks in said sounds.

3. In a variable matrix decoding apparatus intended for the periphonic reproduction of sound from matrix encoded audio input signals, said variable matrix decoding apparatus having an input matrix means for providing combination signals from said encoded audio input signals to means for generating a plurality of control signals representing the directional content of said matrix encoded audio input signals, and a variable matrix decoding means responsive to said control signals for matrix decoding said audio input signals to produce a plurality of output signals for driving a corresponding plurality of surrounding loudspeakers in a room, an improvement comprising a control interface circuit in the control signal path between said means for generating a plurality of control signals and said variable matrix decoding means, said control interface circuit having means for detecting the total signal level of matrix encoded input signals, means responsive to said total signal level of said matrix encoded input signals for detecting an audio signal attack comprising a low-pass filter, a two-stage differentiator, means for preventing the output of said two-stage differentiator from remaining higher than the output of said low-pass filter, and means for producing a pulse for a predetermined short period when the output of said two-stage differentiator exceeds a predetermined voltage level in response to a fast increase in the amplitude of said total signal level, thereby detecting an audio signal attack, and means in response to a detected audio signal attack for shortening the attack time constant for said control signals for a defined short period following the onset of a detected audio signal attack, and for setting a longer time constant following the short period of said shortened time constant, and for varying a set of control coefficients for said control signals for said variable matrix decoding means for a defined short period immediately after detecting the onset of an attack.

4. In a variable matrix decoding apparatus intended for the periphonic reproduction of sound using encoded audio input signals, said variable matrix decoding apparatus having an input matrix means for providing combination signals from said encoded audio input signals to means for generating a plurality of control signals representing directional content of said encoded audio input signals, and a variable matrix decoding means responsive to said control signals for matrix decoding said audio inut signals to produce a plurality of output signals for driving a corresponding plurality of surrounding loudspeakers in a room, an improvement comprising a control interface circuit in the control signal path between said means for generating a plurality of control signals and said variable matrix decoding means, said control interface circuit having means for detecting the total signal level of encoded audio input signals, means responsive to said total signal level of said encoded audio input signals for detecting an audio signal attack, and means in response to a detected audio signal attack for shortening an attack time constant for said control signals for a defined short period following the onset of a detected audio signal attack, for increasing the rate at which said variable matrix decoding means responds to encoded audio input signals for a defined short period immediately after detecting the onset of an attack, wherein said short period of said shortened time constant for said control signals is defined to be short enough to minimize the audibility of intermodulation distortion, and for setting a reduced rate at which said variable matrix decoding means responds to encoded audio input signals after said short period of increased rate at which said variable matrix decoding means responds immediately after detecting the onset of an attack.

5. An improvement as defined in claim 4 wherein said reduced rate at which said variable matrix decoding means responds is selected to be low enough to reduce the possibility of producing imperfections in the periphonic reproduction of sound following attacks.

6. An improvement as defined in claim 4 wherein said total signal level detector is comprised of a plurality of circuits, each having a logarithmic amplifier and full wave rectifier in cascade, one circuit for processing each of said audio input signals directly or for processing each of said combination signals derived from said encoded audio input signals by said input matrix means, to provide logarithmic output signals, and means for summing said logarithmic output signals to provide a total signal level output proportional to the total signal level of summed logarithmic output signals, and means for low pass filtering said total signal level output.

7. An improvement as defined in claim 6 wherein said means for detecting an audio signal attack is comprised of means for detecting when said low-pass filtered total signal level output increases in magnitude a predetermined amount in a predetermined period, means responsive to detection of a low-pass filtered total signal level output increase of said predetermined amount for producing an attack pulse of predetermined duration, and means for summing said low-pass filtered total signal and said pulse of predetermined duration, means responsive to the output of said means for summing said low-pass filtered total signal and said pulse of predetermined duration for producing a time constant control signal for shortening the attack and decay time constants of said control signals during the presence of said attack pulse and providing longer time constants following said pulse, and means responsive to said time constant control signal, for imposing a time constant on said control signals representing the directional content of said encoded audio input signals.

8. An improvement as defined in claim 7 wherein said time constant control signal is a pulse-width modulated train of pulses and said means responsive to said output of said means for summing said low-pass filtered total signal and said pulse of predetermined duration for producing a time constant control signal includes a constant frequency oscillator, means for producing a train of pulses at the frequency oscillator, means for producing a train of pulses at the frequency of said oscillator, and means for pulse-width modulation of said train of pulses in response to said output of said means for summing said low-pass filtered total signal and said pulse of predetermined duration, thereby producing a pulse-width modulated time constant control signal.

9. An improvement as defined in claim 8 wherein said means responsive to said time constant control signal comprises means for chopping signals from said means for generating a plurality of control signals representing the directional content of said encoded audio input signals, thereby to produce chopped control signals, and means for filtering said chopped control signals to produce smooth modulated time constant control signals.

* * * * *

UNITED STATES PATENT AND TRADEMARK OFFICE

CERTIFICATE OF CORRECTION

PATENT NO. : 4,932,059

DATED : June 5, 1990

INVENTOR(S) : James W. Fosgate

It is certified that error appears in the above-identified patent and that said Letters Patent is hereby corrected as shown below:

Title Page of Letters Patent delete:

[73] Assignee: Fosgate Inc., Heber City, Utah

Signed and Sealed this

Sixth Day of October, 1992

*Attest:*

DOUGLAS B. COMER

*Attesting Officer*

*Acting Commissioner of Patents and Trademarks*